US005590516A

United States Patent [19]

Schwartz

[11] Patent Number: 5,590,516

[45] Date of Patent: Jan. 7, 1997

[54] JEWELRY CHAIN

[76] Inventor: Tibor Schwartz, 1554 46th St., Brooklyn, N.Y. 11219

[21] Appl. No.: 553,766

[22] Filed: Oct. 23, 1995

[51] Int. Cl.[6] ..... F16G 13/00

[52] U.S. Cl. ..... 59/80

[58] Field of Search ..... 59/78, 80

[56] References Cited

U.S. PATENT DOCUMENTS

| | | | |
|---|---|---|---|
| 240,168 | 4/1881 | Nortemann | 59/80 |
| 326,065 | 5/1992 | Borgogni . | |
| 1,476,462 | 12/1923 | Pejchar | 59/80 |
| 1,596,607 | 8/1926 | Forstner | 59/80 |
| 4,972,670 | 11/1990 | Lapini et al. | 59/80 |
| 4,996,835 | 3/1991 | Rozenwasser . | |
| 5,125,225 | 6/1992 | Strobel . | |
| 5,129,220 | 7/1992 | Strobel . | |
| 5,155,990 | 10/1992 | Poll | 59/80 |

*Primary Examiner*—David Jones
*Attorney, Agent, or Firm*—Helfgott & Karas, P.C.

[57] ABSTRACT

A decorative chain is constructed from a series of links, each constructed from a pair of half links. Each half link includes a pair of individually formed or jointly formed quarter links which take the form of generally C-shaped open loops. The free ends of one pair of quarter links are rigidly welded to the free ends of a second pair of quarter links at four separate weld points so as to form a single link.

15 Claims, 4 Drawing Sheets

JEWELRY CHAIN

BACKGROUND OF THE INVENTION

1. Field of the Invention

The present invention relates generally to chains and in particular to a decorative chain constructed from a series of links, each fabricated from a pair of V-shaped half links.

2. Description of Prior Developments

Decorative chains have been constructed in many different configurations for providing various distinctive visual effects. A common form of jewelry chain is constructed from individual interconnected links, each formed from a single loop of wire. Although these chains present a pleasing appearance, they are quite common.

Accordingly, a continuing need exists for a jewelry chain having a distinctive appearance which presents a pleasing visual effect when worn around one's neck, wrist or ankle.

SUMMARY OF THE INVENTION

The present invention has been developed to fulfill the needs noted above and therefore has as an object the provision of a jewelry chain having a distinctive decorative appearance significantly different from presently available jewelry chains.

Another object is to provide a jewelry chain which is constructed from V-shaped half links interconnected at their free ends to form individual decorative links.

Another object of the invention is to provide a jewelry chain wherein wire links are constructed in such a configuration that each ninety degree rotation of the chain about its longitudinal axis produces a mirror image of the immediately preceding chain pattern.

These and other objects are achieved in accordance with the present invention wherein a decorative chain is constructed from a plurality of links, each of which includes a pair of V-shaped half links. Each half link may be fabricated from a pair of individual quarter links or from a single stamping.

In each case, the free ends of the half links are rigidly interconnected by welding which includes brazing, soldering and the like. However, any suitable type of joint between the free ends is encompassed by the invention, including joints formed by heating, crimping and bonding. As used herein, the terms weld and welding are intended to cover both fusion joints wherein the weld metal is melted and the parts are joined without pressure and plastic joints where the weld metal is viscous and the parts are joined by pressure.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

The invention will now be described in conjunction with the drawings, beginning with FIG. 1, which shows an open loop quarter link 10 which forms a basic component used to produce a chain in accordance with the invention. Quarter link 10 may be formed from any suitable straight or coiled wire by a simple mechanized or manual cutting and bending operation. Gold, silver, copper, brass or any other wire material may be used to form the quarter links.

Although the quarter links shown in FIGS. 1 through 11 are constructed from wire having a circular cross section, any cross section may be used. For example, oval, square, hexagonal, or rectangular sectioned wire as well as twisted wire may be used to form the quarter links.

Figure 1:
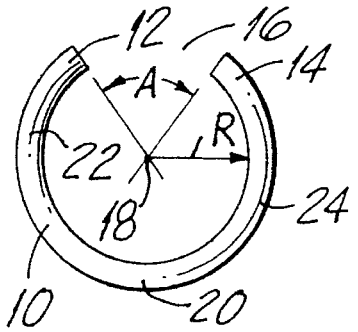
FIG. 1 is a front elevation view of an individual circular open loop for use in constructing a half link in accordance with the present invention.

As seen further in FIG. 1, quarter link 10 is formed with a pair of somewhat opposed free ends 12,14 which define an open area or sector 16 therebetween. Sector 16 can extend over an angle A which can vary from about 10° up to about 180° depending on the thickness of the wire section relative to the radius R of the quarter link. In one preferred embodiment, angle A can extend between 15° and 45°.

Quarter link 10 further includes a central base portion 20 which is located diametrically opposed to the open sector or mouth 16. Legs 22 and 24 extend along opposite sides of quarter link 10 and interconnect the free ends 12,14 with the base portion 20.

Figure 2:
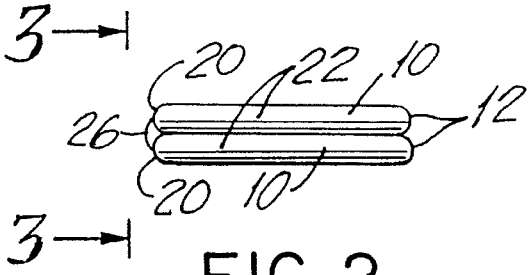
FIG. 2 is a pair of two loops of FIG. 1 stacked one upon the other and interconnected by a joint such as a weld.

In order to construct a half link in accordance with one embodiment of the invention, two quarter links 10,10 are stacked, one against the other as shown, for example, in FIG. 2. A joint 26 is then formed between the adjacent base portions 20,20 using any suitable joining technique. For example, a fusion type joint produced by the application of heat such as by soldering, brazing, or welding may be used to form joint 26. In the embodiment shown, joint 26 is depicted as a weld.

Figure 3:
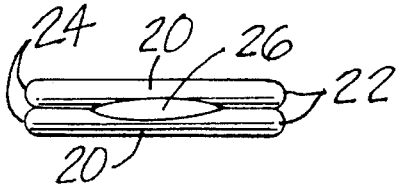
FIG. 3 is a bottom view of the stacked loops of FIG. 2 showing the shape and location of an interconnecting weld joint.

As seen in FIG. 3, weld joint 26 may extend over an arc of about 10° to 45°, depending on the size of the quarter links. Although only one pair of quarter links is shown joined by a single weld joint 26 in FIGS. 2 and 3, it is possible to join a long series of stacked or abutted quarter links with a single continuous weld joint.

Figure 4:
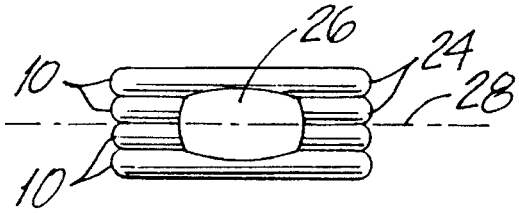
FIG. 4 is a view similar to FIG. 3 showing a series of open loops of the type shown in FIG. 1, stacked one upon the other and interconnected with a single weld for subsequent partitioning.

For example, as shown in FIG. 4, four quarter links 10 are joined along their central base portions 20 by a single weld joint. Two pairs of quarter links, such as shown individually in FIGS. 2 and 3, can then be produced by separating the stack of quarter links 10 of FIG. 4 along parting line 28. A simple cut can be made or the pair of quarter links can be pried apart by bending and flexing the pairs of quarter links along parting line 28.

Figure 5:
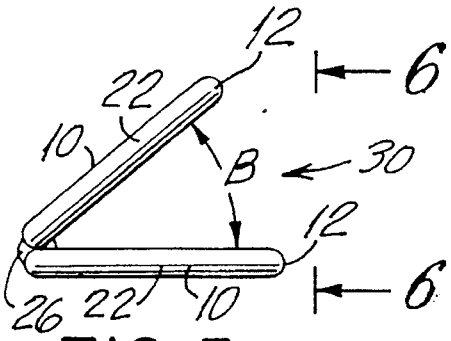
FIG. 5 is a side view of the stacked loop pair of FIG. 3, as subsequently spread apart so as to form a V-shaped quarter link.
Figure 6:
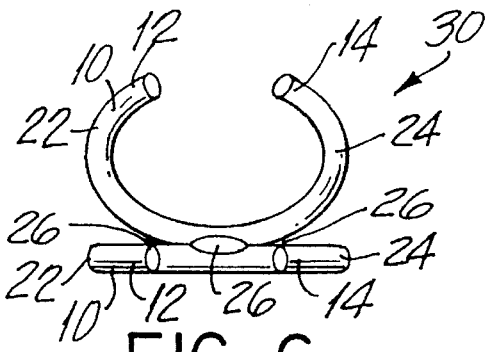
FIG. 6 is a view taken along line 6—6 of FIG. 5.

In order to produce a half link which can be used to construct a full link according to the invention, each pair of quarter links must be pried and flexed open along weld 26 as shown in FIGS. 5 and 6. The resulting half link 30 defines a generally V-shaped profile with one quarter link 10 forming each leg of the "V". Weld 26 extends along the vertex of the "V" with the base portions 20 located along the vertex.

The weld 26 is plastically deformed by prying to such an extent that the quarter links 10 remain separated by an angle B, which may vary from 10° to about 60° depending upon the size of wire used and the diameter of the quarter links. It is, of course, possible to directly connect or weld the quarter links 10 in the V-shaped configuration shown in FIGS. 5 and 6. However, the use of a single joint or bond to unite more than one pair of half links in this case would then require a specialized holding fixture for holding the quarter links in a spoke-shaped array during welding.

Figure 7:
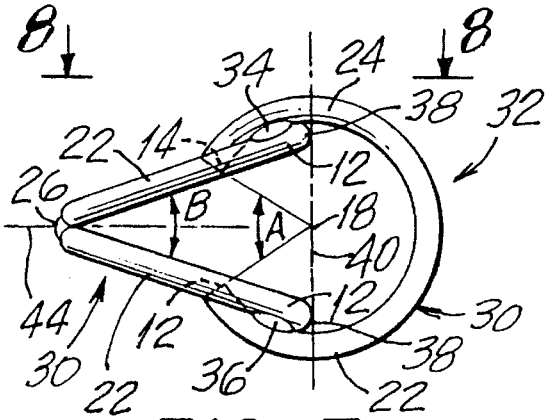
FIG. 7 is a view of a pair of interconnected half links of the type shown in FIGS. 5 and 6.
Figure 8:
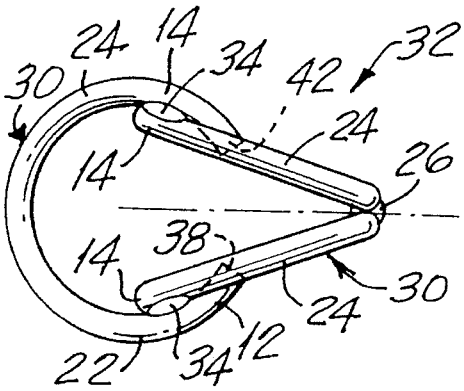
FIG. 8 is a top view taken along line 8—8 of FIG. 7.

A full link 32, as shown in FIGS. 7 and 8, is constructed from a pair of half links 30,30. A first pair of rigid joints such as welds 34,34 is formed between the adjacent end portions 14,14 and 14,12 of one pair of half links as seen in FIG. 8 and a similar second pair of rigid joints such as welds 36,36 is formed between the remaining adjacent end portions 12,12 and 14,12 of the half links. Only one weld joint 36 can be seen formed between end portions 12,12 in the bottom portion of FIG. 7, however, a similar weld joint 36 is located directly below weld 34 between end portions 14,14 of FIG. 8.

In order to form a suitable full link, the end portions 12,12 of one half link shown in FIG. 7 are joined, i.e. welded, with their end tips 38 located approximately on a diametral line 40 extending across the approximate center of the opposing half link 30. The remaining end tips 42 (FIG. 8) are joined, i.e. welded, in corresponding diametral positions. This orientation and weld joint positioning results in general symmetry in the full link 32 as shown in FIGS. 7 and 8.

That is, by rotating in either direction the full link 32 of FIG. 7 through 90°, a mirror image full link 32 results as clearly seen in FIG. 8. The original view of FIG. 7 is achieved by another ninety degree rotation of FIG. 8 in either direction. Thus, by rotating link 32 through four ninety degree rotations, four separate side profiles of link 32 come into view. Each side profile of full link 32 includes at least one C-shaped profile and at least one V-shaped profile, each produced respectively by one of the half links.

Another way of establishing and defining this symmetry is by joining or welding a pair of half links 30,30 together in such a manner that the plane 44 which bisects angle B of one half link 30, as seen in FIG. 7, also bisects angle A of each open mouth area 16 of the other half link 30 to which it is welded. In this manner, the center 18 of each quarter link of one half link 30 is intersected by plane 44.

Figure 9:
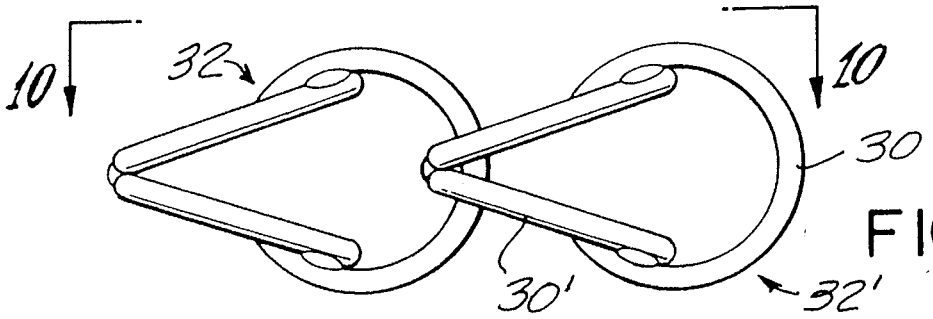
FIG. 9 is a view of a pair of links of the type shown in FIG. 8 and interconnected in accordance with the present invention.
Figure 10:
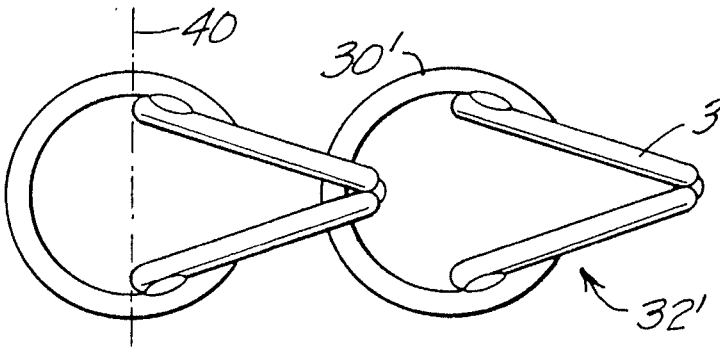
FIG. 10 is a top view taken along line 10—10 of FIG. 9.
Figure 11:
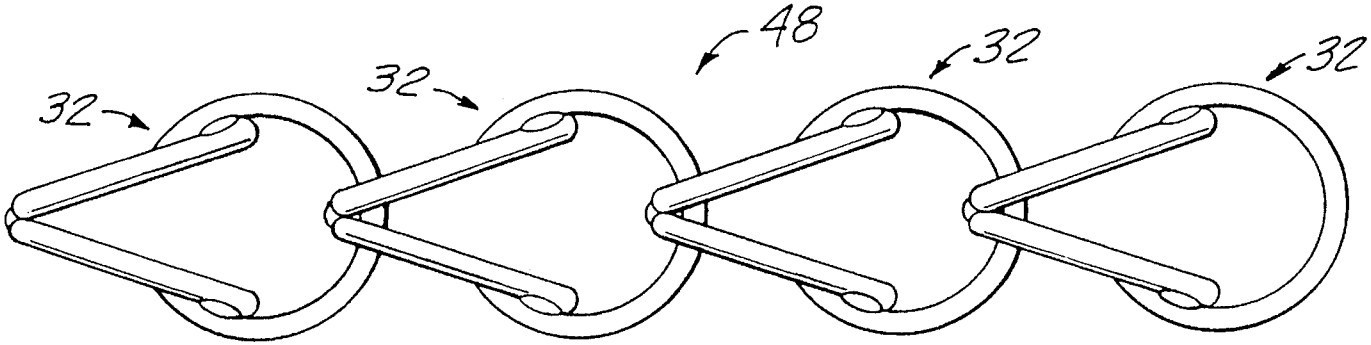
FIG. 11 is a view of a four-link chain constructed in accordance with the invention.
Figure 12:
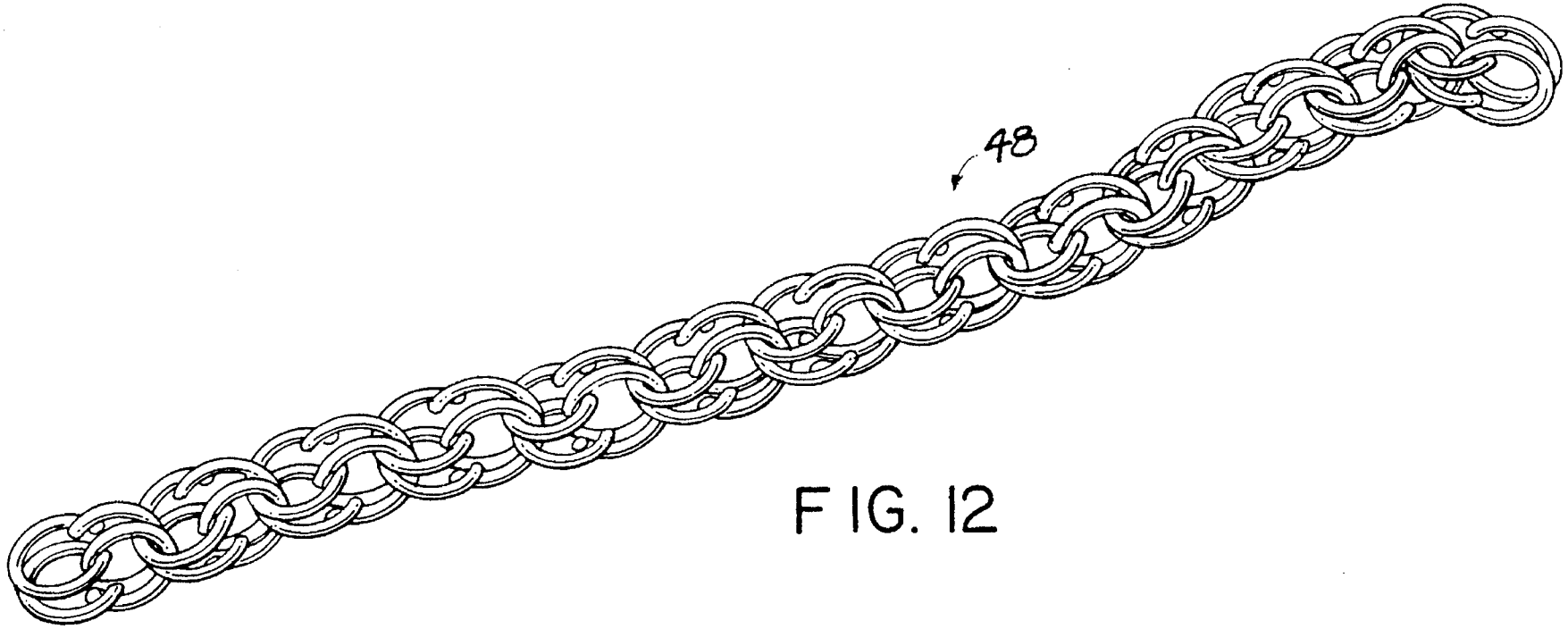
FIG. 12 is a perspective view of an elongated multi-link chain constructed from the shorter four-link chain of FIG. 11.

In order to form a second full link 32' interconnected to a first full link 32, a half link 30' is looped through a full link 32 as shown in FIGS. 9 and 10. Another half link 30 is then joined, i.e. welded, to half link 30' as described above to complete full link 32. This process may be repeated to produce a chain 48 as shown in FIG. 11 having any length as desired. For example, a relatively long chain based on the chain of FIG. 11 is shown in FIG. 12.

Figure 13:
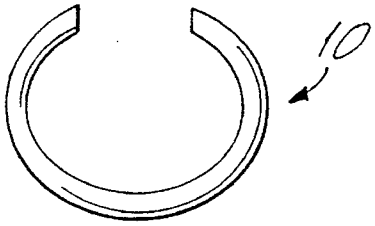
FIGS. 13 through 18 are views of various shaped quarter links which may be used in constructing a chain in accordance with the invention.
Figure 16:
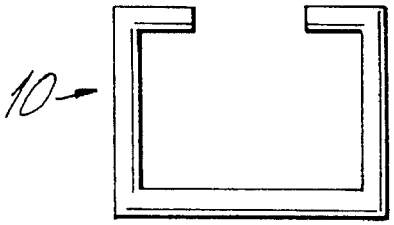
Figure 17:
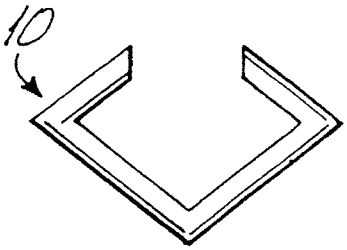

It is, of course, possible to practice the invention with quarter links and half links having shapes other than the generally circular quarter links as described above. For example, oval shaped quarter loops as shown in FIGS. 13, 14 and 15, as well as rectangular, rhombic and polygonal shaped quarter loops as respectively shown in FIGS. 16, 17 and 18 can be united to fabricate half links and full links and chains in accordance with the invention.

Figure 14:
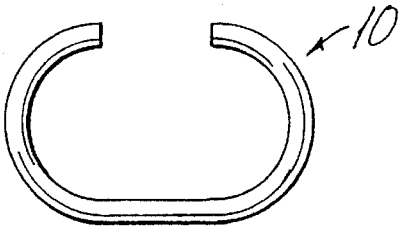
Figure 15:
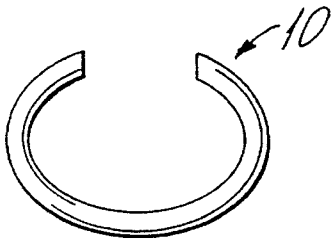
Figure 18:
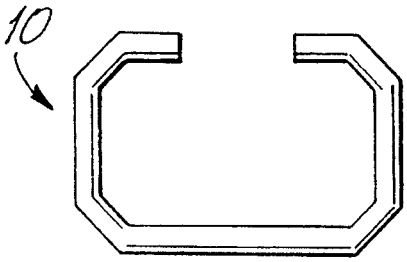

It is also possible to form a chain 48 which includes any combination of full links constructed from any of the various shaped quarter links of the types such as depicted in FIG. 1, and FIGS. 13 through 18. That is, a full link constructed from substantially circular quarter links, as shown in FIG. 7, can be connected to a full link constructed from polygonal quarter links of the type such as shown in FIG. 18, which can in turn be connected to a full link constructed from oval quarter links such as shown in FIG. 14. The number of variations in link selection and arrangement is virtually limitless.

Figure 19:
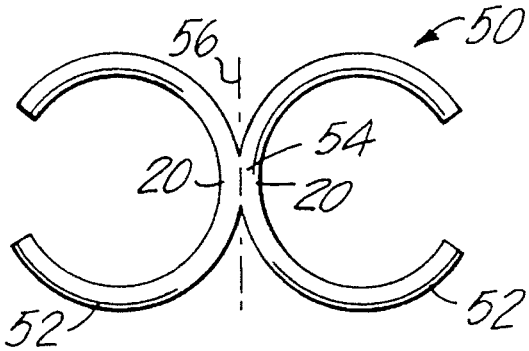
FIG. 19 is a view of a stamping for forming a one-piece half link according to the invention.
Figure 20:
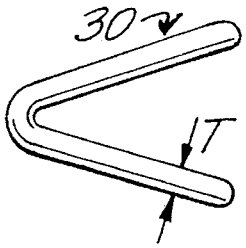
FIG. 20 is a one-piece half link formed from the stamping of FIG. 18.

Instead of fabricating each half link from a pair of quarter links, it is possible to form each half link from a one-piece stamping 50 as shown in FIGS. 19 and 20. Each stamping 50 includes a pair of quarter links 52 having any of the shapes noted above. Rather than being welded along their central base portions 20 as noted above in connection with the previous embodiments, each pair of quarter links 52 is stamped together with a continuous one-piece base 54 which is coextensive with each central base portion 20.

Each quarter link 52 is stamped as a mirror image of its attached quarter link with a line of symmetry 56 extending therebetween. As seen in FIG. 20, a one-piece half link 30 is constructed by bending and plastically deforming stamping 50 along and around symmetry line 56. In this case, the one-piece half link 30 will have a rectangular cross section with a thickness T equal to the thickness of the sheet metal from which the stamping is taken. It is also possible to cast a homogeneous unitary half link in the general form as shown in FIGS. 5 and 19.

Figure 21:
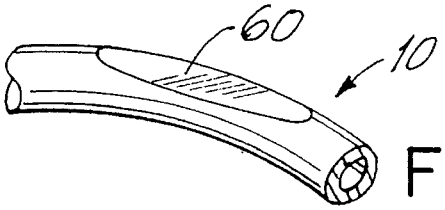
FIG. 21 is a fragmental enlarged view of a faceted hollow quarter link according to the invention.

The quarter links and half links can be constructed from either solid wire as seen in FIGS. 1 through 12, from sheet metal as seen in FIGS. 19 and 20, or from hollow wire as shown in FIG. 21. It is also possible to enhance the appearance of the links by scoring or faceting their surface. For example, a flattened facet 60 may be formed on any quarter link 10 by cutting, grinding, hammering, or any other well know surface treating technique. Additional modifications are possible by forming each quarter link from twisted wire or twisted strand wire.

A particularly decorative and visually pleasing chain link 32 can be formed by cutting generally diamond shaped grooves into each weld joint 34,34,36,36 (FIGS. 7 and 8). A grinding tool or the like can be used to smooth out and flatten the soldered joints and at the same time provide decorative, generally diamond shaped cuts upon each joint. The resulting link will produce a sparkling effect on each of its four sides as it is rotated through 360 degrees.

There has been disclosed heretofore the best embodiment of the invention presently contemplated. However, it is to be understood that various changes and modifications may be made thereto without departing from the spirit of the invention. For example, chain 48 can be overplated to provide a one-tone surface color. Moreover, the half links could be combined in various other configurations, such as in groups of three or more to form other decorative chain configurations. Finally, the full links could be cast as one-piece links and subsequently interconnected by any suitable link joining technique.

What is claimed is:

1. A decorative chain link, comprising:

a first quarter link having a first central base portion, a first pair of legs extending from said first base portion, each one of said first pair of legs extending to a first free end portion, said first pair of legs defining a first open mouth extending between each first free end portion;

a second quarter link having a second central base portion connected to said first central base portion of said first quarter link so as to form a first half link having a first V-shaped profile formed with a first vertex defined between said first and second base portions, a second pair of legs extending from said second base portion, each one of said second pair of legs extending to a second free end portion, said second pair of legs defining a second open mouth extending between each second free end portion;

a third quarter link having a third central base portion, a third pair of legs extending from said third base portion, each one of said third pair of legs extending to a third free end portion, said third pair of legs defining a third open mouth extending between each third free end portion;

a fourth quarter link having a fourth central base portion connected to said third central base portion so as to form a second half link having a second V-shaped profile formed with a second vertex defined between said third and fourth base portions, a fourth pair of legs extending from said base portion, each one of said fourth pair of legs extending to a fourth free end portion, said fourth pair of legs defining a fourth open mouth extending between each fourth free end portion; and said first and second half links being rigidly united at said first, second, third and fourth free end portions such that said first V-shaped profile is perpendicular to said second V-shaped profile.

2. The chain link of claim 1, wherein said first and second central base portions are connected by a weld.

3. The chain link of claim 1, wherein said first and second base portions are formed together as a one-piece stamping.

4. The chain link of claim 1, wherein said first, second, third and fourth end portions of said first and second half links are united by welding.

5. The chain link of claim 4, wherein said first end portions of said first quarter link are respectively welded to one of said third end portions of said third quarter link and to one of said fourth end portions of said fourth quarter link.

6. The chain link of claim 5, wherein said second end portions of said second quarter link are respectively welded to the other one of said third end portions of said third quarter link and to the other one of said fourth end portions of said fourth quarter link.

7. The chain link of claim 1, wherein said first and second quarter links comprise substantially C-shaped loops.

8. The chain link of claim 1, wherein said second half link forms a mirror image of said first half link when said second link is rotated 90°.

9. A decorative chain half link, comprising:

a first quarter link having a first central base portion, a first pair of legs extending from said first base portion, each one of said first pair of legs extending to a first free end portion and defining between each first free end portion a first open mouth disposed opposite to said first central base portion and extending between each said free end portion;

a second quarter link having a second central base portion connected to said first central base portion of said first quarter link and a second pair of legs extending from said second base portion, each one of said second pair of legs extending to a second free end portion and defining a second open mouth disposed opposite to said second central base portion and extending between each said free end portion such that said first and second quarter links define a V-shaped profile having a vertex defined between said first and second base portions.

10. The half link of claim 9, wherein said first link forms one leg of said V-shaped profile and said second link forms the other leg of said V-shaped profile, said first and second legs meeting at said vertex.

11. The half link of claim 10, wherein said first and second quarter links are connected at the vertex of said V-shaped profile.

12. A decorative chain comprising a plurality of links interconnected by welding and wherein each one of said links comprises four quarter links each having a pair of legs defining an open mouth and at least four welds rigidly interconnecting said legs, wherein each one of said quarter links comprises a base portion and one of said pair of legs each leg of which extends from said base portion to a free end portion with said open mouth extending between said free end portions of each pair of legs, and wherein said four quarter links are respectively rigidly interconnected by said at least four welds at said free end portions.

13. The chain of claim 12, further comprising a fifth weld interconnecting two of said quarter links so as to form a first half link.

14. The chain of claim 13, further comprising a sixth weld interconnecting the other two of said quarter links so as to form a second half link.

15. The chain of claim 12, wherein each one of said quarter links comprises an open loop.

* * * * *